US006050258A

United States Patent [19]

Neitzel et al.

[11] Patent Number: 6,050,258

[45] **Date of Patent: *Apr. 18, 2000**

[54] EXHAUST FAN WITH DRY LUBRICANT COATING

[75] Inventors: Emery W. Neitzel, Rothschild; Arnold S. Heil, Wausau; David C. Dahl, Merril; Joseph A. Knoedler, Mosinee, all of Wis.

[73] Assignee: Greenheck Fan Corporation, Schofield, Wis.

[ * ] Notice: This patent is subject to a terminal disclaimer.

[21] Appl. No.: 09/094,745

[22] Filed: Jun. 15, 1998

Related U.S. Application Data

[63] Continuation of application No. 08/863,110, May 23, 1997, Pat. No. 5,809,993.

[51] Int. Cl.[7] ..... F24C 15/20

[52] U.S. Cl. ..... 126/299 R; 126/299 D; 454/356

[58] Field of Search ..... 126/299 R, 299 D, 126/299 E; 454/16, 341, 356

[56] References Cited

U.S. PATENT DOCUMENTS

| | | | |
|---|---|---|---|
| 3,837,269 | 9/1974 | Sweet et al. | 126/299 E |
| 4,086,043 | 4/1978 | Howe | 418/152 |
| 4,363,642 | 12/1982 | Stahl | 126/299 E X |
| 5,205,279 | 4/1993 | Brown | 126/299 D X |
| 5,372,122 | 12/1994 | Hong et al. | 126/299 R |

OTHER PUBLICATIONS

954–100 Series–Teflon–S Nonstick Finishes, Teflon Industrial Coatings, Du Point Co., Fabricated Products Department, Wilmington, DE.

*Primary Examiner*—Harold Joyce
*Attorney, Agent, or Firm*—Quarles & Brady LLP

[57] ABSTRACT

An upblast exhaust fan for commercial kitchens is constructed with components that are coated with a dry lubricant. The non-stick surfaces that collect grease condensed from the hot cooking gases are easily cleaned with hot water during routine maintenance.

14 Claims, 2 Drawing Sheets

EXHAUST FAN WITH DRY LUBRICANT COATING

CROSS REFERENCES TO RELATED APPLICATIONS

This application is a continuation of U.S. patent application Ser. No. 08/863,110 filed on May 23, 1997. U.S. Pat. No. 5,809,993.

STATEMENT REGARDING FEDERALLY SPONSORED RESEARCH

Not Applicable

BACKGROUND OF THE INVENTION

The field of the invention is exhaust fans, and more particularly, exhaust fans for commercial kitchens.

Exhaust fans for kitchen ventilation applications must be capable of handling hot, grease-laden air The fan motor must be kept out of the air stream, which can reach temperatures of up to 300° F., and effectively cooled to prevent premature failure. In addition, the motor must be enclosed to prevent grease build-up on the motor which acts as a thermal insulator and prevents it from being properly cooled. To prevent damage to the roof which supports the exhaust fan, it should contain and properly drain all grease removed from the airstream. This requires that the fan components be sealed such that any grease which collects inside the fan will drain only through a drain trough into a grease collection and removal system.

There are many types of exhaust fans in common use in restaurants. An "upblast" exhaust fan is designed for roof mounting directly on top of the exhaust stack which extends upward from the interior of the building, and it directs the grease-laden air upward, away from the roof. Upblast exhaust fans typically have an integral grease drainage system and grease trap or removal system, and they are usually cleaned by hinging them back from the exhaust stack. A "utility set" exhaust fan is also usually mounted on the roof of the restaurant and its discharge is orientated to direct exhausted air away from the roof. The housing of the fan is generally sealed and has a drain at the bottom to remove grease and moisture. These fans are usually cleaned by removing access panels or duct extensions. Access to the fan and associated duct system is very limited and quite difficult at best. An "inline" exhaust fan is typically mounted in the exhaust duct which is located inside the building. It is used when the fan cannot be mounted outside, either on the roof or on an outside wall. Inline exhaust fans are typically cleaned by removing them from the duct system or through access openings in the fan or duct system. Grease and moisture are removed from the fan by a drain located at the bottom of the fan's housing. In all applications of these various styles of exhaust fans, the build-up of grease on the fan components exposed to the cooking gases is relentless and is a significant maintenance problem.

All components of a ventilation system are designed to operate in balance with each other to properly capture, contain, and remove the cooking gases and heat. Grease build-up on the fan will reduce its aerodynamic performance which unbalances the system, affecting its operation, or efficiency. Additionally, the build-up of grease on exhaust fan components can create health and fire hazards if not routinely removed. Grease build-up, if not removed will also create mechanical unbalance and excessive vibration. This excessive vibration will create noise in the system and reduce the life of the fan. Accordingly, the removal of grease build-up on exhaust fan components is a scheduled procedure that is performed regularly as part of a maintenance program.

For an exhaust fan on a typical restaurant, cleaning may be required every three to six months depending on the application. Removing the grease build-up on prior designs typically requires a pre-soak with strong cleaning solutions, high pressure hot water rinse and scraping. Typically, this cleaning process needs to be repeated several times to remove the grease and baked on deposits. The harsh cleaning solutions cause damage to the system's components and the roofing, and may be hazardous for cleaning personnel. The large quantity of hot water required for cleaning must be contained and removed from the roof of the restaurant. Scraping the unit to remove baked on deposits can cause damage to the fan by removing balance weights or bending the wheel or shaft. Removing these weights will cause excessive vibration. Excessive vibration will cause noise in the structure below and lead to premature fan failure. A typical cleaning of an upblast exhaust fan may take 2 to 3 hours to perform and become very costly due to the time, chemicals and hot water used and the potential for damage to the roof.

SUMMARY OF THE INVENTION

The present invention is an improved exhaust fan for restaurant applications which produce hot, grease-laden cooking gases. More particularly, the invention is an exhaust fan in which substantially all the surfaces therein that are exposed to the cooking gases are coated with a dry lubricant finish that reduces the adhesion of grease to the surfaces. It has been discovered that by using a dry lubricant coating on the exposed exhaust fan surfaces, grease build-up is reduced and cleaning the fan is vastly simplified.

A general object of the invention is to reduce the number of times a fan needs to be cleaned and the time and cost for cleaning grease from an exhaust fan. By coating the exposed surfaces with the dry lubricant finish, grease deposits can be flushed from the surfaces with a stream of hot water. Little or no scrubbing is required and no cleaning agents need be used. A typical upblast exhaust fan can be cleaned in 15 minutes.

Another object of the invention is to provide a dry lubricant finish for the exposed fan surfaces which is economical, durable and easy to apply. A fluorocarbon resin such as that sold commercially by the DuPont Company under the trademark "Teflon" is particularly well suited for this purpose. It can be sprayed on the exposed surfaces and cured in twenty minutes.

These and other objects and advantages of the invention will be apparent from the description that follows. In the description reference is made to the accompanying drawings which form a part hereof and in which there is shown by way of illustration embodiments of the invention. Such embodiments do not necessarily represent the full scope of the invention. Reference should therefore be made to the claims herein for interpreting the scope of the invention.

DESCRIPTION OF THE PREFERRED EMBODIMENT

Figure 1:
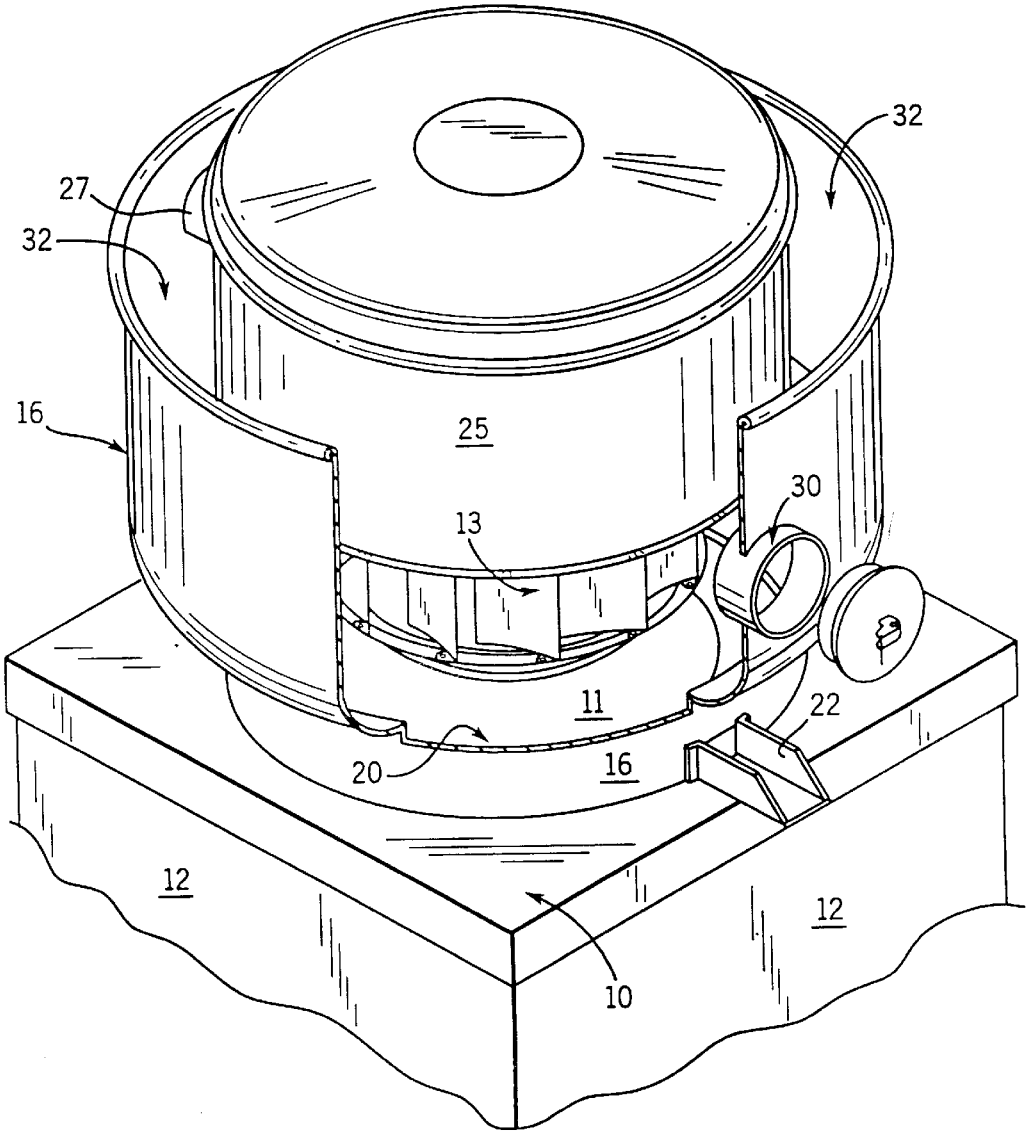
FIG. 1 is a perspective view with parts cut away of a preferred embodiment of an exhaust fan which employees the present invention.
Figure 2:
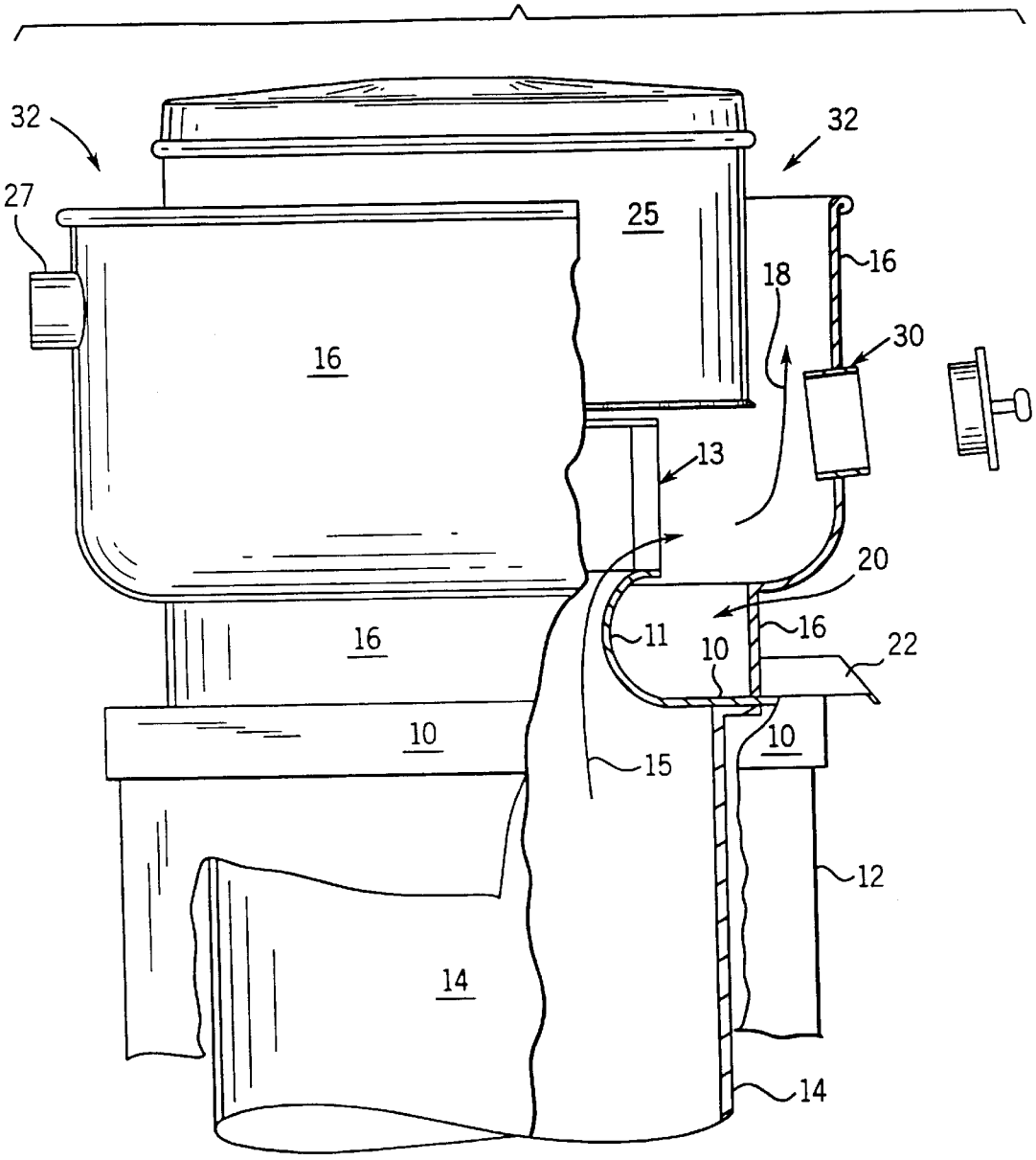
FIG. 2 is an elevation view of the exhaust fan of FIG. 1 with parts cut away.

Referring particularly to FIGS. 1 and 2, an upblast exhaust fan includes a rectangular curb cap 10 which serves as a supporting base for the fan and which is mounted on top of a curb 12 that extends upward from the roof deck (not shown) a distance required by the local building code. An exhaust stack 14 extends upward through the curb 12 and engages the bottom of the curb cap 10. An exhaust opening is formed in the center of the curb cap 10, and an integrally formed venturi 11 extends upward therefrom to funnel the cooking gases from the top of the exhaust stack 14 into a centrifugal fan 13. Cooking gases flowing up the exhaust stack 14 are thus drawn into the venturi 11 and blown radially outward by the fan 13 as indicated by arrow 15.

A one-piece windband 16 formed from aluminum is welded to the top of the curb cap 10 and positioned concentrically around the centrifugal fan 13. The windband 16 re-directs the cooking gases upward as they exit the fan 13 as indicated by arrow 18. Large amounts of grease condense on the inner surface of the windband 16, the fan 13 and venturi 11 and flow downward to the top surface of the curb cap 10. The attachment of the windband 16 to the curb cap 10 provides a grease seal, and the sump 20 thus formed, channels the condensed grease to a grease trough 22. A grease trap (not shown) is mounted beneath the trough 22 to collect the grease in a container which can be periodically emptied.

A motor compartment 25 is supported above the centrifugal fan 13. It houses an electric motor (not shown) which engages and rotates the centrifugal fan about a vertical axis. The housing for the motor compartment 25 is also formed from aluminum to provide a weather-tight barrier for the motor and associated electronics. A breather tube 27 inserted through aligned openings in the compartment 25 and windband 16 provides an air passage for cooling air for the motor.

Grease condenses on nearly all the surfaces that are exposed to the cooking gases as they flow through the exhaust fan. In a typical restaurant the exhaust fan may require cleaning every three to six months depending on the severity of the application. Prior to the present invention this was done by exposing all grease covered surfaces. In an "upblast" fan this requires laying the fan on its side. On a "utility set" or "inline" this requires removal of access doors and possibly the duct system. Once the critical surfaces are exposed, they are sprayed with a cleaning solution. The solution is given time to act. The cleaning solution and loosened grease is removed by a high pressure hot water spray. In most cases this process is repeated. A scrapping operation is required to remove baked on or stubborn deposits. The cleaning solution, hot water and grease must be contained and removed to eliminate potential damage to system components and the roof.

The discovery of the present invention is that by selectively coating the exhaust fan surfaces that are exposed to the cooking gases with a dry lubricant, the job of cleaning the fan can be significantly reduced. Most importantly, the reduction in cleaning costs of a typical exhaust fan offsets the modest increase in cost of applying the dry lubricant coating to the fan components within two to three cleaning operations. For the remainder of the fan's useful life, the user realizes savings through reduced maintenance costs and more reliable fan operation.

In the preferred embodiment a number of component surfaces are coated with dry lubricant. The bottom surface of the curb cap 10, both surfaces of the venturi 11, the centrifugal fan 13 and the interior surface of the windband 16 are coated. In most applications grease does not condense on the outside surface of the motor compartment 25 in sufficient amounts to justify the added cost of coating it. However, it can be appreciated that there may be applications where this should be coated as well.

A fluoropolymer resin was chosen for the dry lubricant coating because of its extremely low coefficient of friction, its durability, and its reasonable cost. An industrial coating sold by DuPont under the trademark "TEFLON-S" is preferred. It is applied to the surface of each fan component to be coated after the component is cut and shaped. The surface to be coated is thoroughly cleaned of any residual oils that may be present. The surfaces are then sand blasted to roughen them and aluminum components are pre-treated with chrome phosphate. The components are then baked to completely drive off any moisture and the fluoropolymer resin is applied in an electrostatic process. The coated components are then baked to cure the resin.

The exhaust fan of the present invention can be cleaned with nothing more than hot water. A clean-out port 30 is formed in the windband 16 to enable water to be directed at the blades on the centrifugal fan 13. The inner surface of the windband 16 and the surfaces in the sump 20 may be cleaned by directing water downward through the annular opening 32 formed between the motor compartment 25 and windband 16. The water and released grease particles exit through the trough 22. The actual cleaning process typically requires fifteen minutes to perform. No harsh chemicals are required, and a fraction of the water previously used for cleaning is needed.

We claim:

1. In an exhaust fan having, a motor driven fan surrounded by an enclosure which connects to an exhaust stack that conveys hot, grease-laden cooking gases from a kitchen, the improvement therein comprising:

coating a surface of the exhaust fan which is exposed to the cooking gases with a material that facilitates the removal of condensed grease therefrom.

2. The improvement as recited in claim 1, wherein said surface is a surface of the enclosure which is exposed to the cooking gases.

3. The improvement as recited in claim 1, wherein said surface is a surface of the motor driven fan which is exposed to the cooking gases and the coating is a dry lubricant.

4. The improvement as recited in claim 1, further comprising coating a surface of the exhaust stack which is exposed to the cooking gases with a dry lubricant.

5. The improvement as recited in claim 1 in which the coating is a dry lubricant which includes a fluoropolymer resin.

6. The improvement as recited in claim 5 in which the fluoropolymer resin is coated on said surface by spraying the resin on said surface and curing the fluoropolymer resin at an elevated temperature.

7. An exhaust fan for exhausting cooking gases from an exhaust stack, said exhaust fan comprising:

a curb cap connected to the end of the exhaust stack and defining an opening through which the cooking gases flow;

a centrifugal fan mounted over said opening and having fan blades which are rotated about an axis to direct the cooking gases radially outward; and a windband mounted to the curb cap and extending away therefrom to define an annular space that surrounds the centrifugal fan;

wherein a surface of the exhaust fan is coated with a dry lubricant that facilitates the removal of condensed grease therefrom.

8. The exhaust fan as recited in claim 7, wherein said surface is a surface of at least one fan blade.

9. The exhaust fan as recited in claim 7, wherein said surface is a surface of the curb cap.

10. The exhaust fan as recited in claim 7, wherein said surface is a surface of the windband.

11. The exhaust fan as recited in claim 7 in which the dry lubricant includes a fluoropolymer resin.

12. The exhaust fan as recited in claim 7 in which the fluoropolymer resin is coated on said surface by spraying the resin on said surface and curing the fluoropolymer resin at an elevated temperature.

13. The exhaust fan as recited in claim 7 in which a clean-out port is formed in the windband at a location which enables access to the fan blades for cleaning.

14. The exhaust fan as recited in claim 7 in which the curb cap is formed into a venturi around said opening and the surface of said venturi is coated with said dry lubricant.

* * * * *